US005479801A

United States Patent [19]

Keller

[11] Patent Number: 5,479,801

[45] Date of Patent: Jan. 2, 1996

[54] WEB FOR A BUILT-IN DOUBLE LOCK CYLINDER

[76] Inventor: Ernst Keller, Untere Schwandenstrasse 22, CH-8805 Richterswil, Switzerland

[21] Appl. No.: 162,296

[22] Filed: Dec. 7, 1993

[30] Foreign Application Priority Data

Jan. 27, 1993 [CH] Switzerland ..... 231/93

[51] Int. Cl.[6] ..... E05B 9/04

[52] U.S. Cl. ..... 70/373; 70/370; 70/DIG. 60

[58] Field of Search ..... 70/373, 374, DIG. 60, 70/370, 451, 372, 391, 448, 449, 466

[56] References Cited

U.S. PATENT DOCUMENTS

| | | | |
|---|---|---|---|
| 3,209,568 | 10/1965 | Patriquin | 70/373 |
| 3,293,892 | 12/1966 | Falk | 70/358 |
| 3,974,671 | 8/1976 | Rossetti | 70/DIG. 60 X |

FOREIGN PATENT DOCUMENTS

| | | | |
|---|---|---|---|
| 0022233 | 1/1981 | European Pat. Off. | 70/DIG. 60 |
| 0438654 | 7/1991 | European Pat. Off. . | |
| 1014197 | 8/1952 | France . | |
| 2210717 | 9/1973 | Germany | 70/DIG. 60 |
| 2319621 | 1/1974 | Germany | 70/DIG. 60 |
| 2343720 | 3/1975 | Germany . | |
| 2548139 | 5/1977 | Germany | 70/DIG. 60 |
| 3502860 | 10/1985 | Germany . | |
| 7800771 | 7/1979 | Netherlands . | |
| 626679 | 11/1981 | Switzerland . | |
| 679169 | 12/1991 | Switzerland . | |
| 1581095 | 12/1980 | United Kingdom | 70/DIG. 60 |

*Primary Examiner*—Lloyd A. Gall
*Attorney, Agent, or Firm*—Browdy and Neimark

[57] ABSTRACT

The invention is directed to a web which has a plurality of parts extending in the longitudinal direction of the web and placed against each other. These parts may be stamped sheet metal parts or cast parts, which can be produced in a very cost-effective manner. Two outer parts can form a shell, into which a stamped interior part of steel has been inserted. These two parts can be produced cost-effectively as cast parts, for example of zinc, aluminum or a plastic material, and the interior part (12) can be produced as a stamped sheet metal part. The invention permits a particularly cost-effective production of the web and in bending tests was shown to be particularly stable.

6 Claims, 1 Drawing Sheet

WEB FOR A BUILT-IN DOUBLE LOCK CYLINDER

BACKGROUND OF THE INVENTION

1. Field of the Invention

The invention relates to a web for a built-in double lock cylinder which connects two cylinder housing parts with each other and has two legs and a center part.

2. Prior Art

A web of this type is known, for example, from Swiss Patent Disclosure CH-A-626 679. It connects the two cylinder housing parts by engaging a cutout of a cylinder blind bore with respectively one leg. The center part connects the two legs and has a threaded bore for receiving a cuff screw. Double lock cylinders with a web allow cost-effective production of the housing parts from sinter metal in a pressing process. However, the production of the web requires a comparatively large manufacturing outlay. The said web is welded together from three pieces of chrome-nickel steel. The pieces have to be drawn, milled and drilled. Thus, several comparatively expensive work steps are required. It is often tried in the course of attempted burglaries to break the web in the center by bending back and forth.

OBJECT AND SUMMARY OF THE INVENTION

It now is the object of the present invention to provide a web of the type mentioned which can be produced considerably more cost-effectively, but still offers a high degree of security.

This object is attained in a web of the type mentioned, in that it is produced from a plurality of parts extending over the length of the web and placed against each other. In a surprising manner, during bending tests the web is even more stable than a solid web. This is presumably due to the fact that during bending the parts placed next to each other can shift slightly in respect to each other. An attempt to break the double lock cylinder by bending it back and forth in the area of the web is even more difficult when a web in accordance with the invention is used. A further advantage of the web of the invention resides in that it can be produced considerably more cost-effectively than a welded web, because the individual parts are of considerably less thickness and can be produced very cost-effectively in the form of stamped sheet metal parts. It is for example possible to produce a web part very cost-effectively from three essentially similar flat stamped sheet metal pieces which offers a high degree of security.

BRIEF DESCRIPTION OF THE DRAWINGS

Exemplary embodiments of the invention will be explained in detail below by means of the drawings.

DETAILED DESCRIPTION OF THE PREFERRED EMBODIMENT(S)

Figure 5:
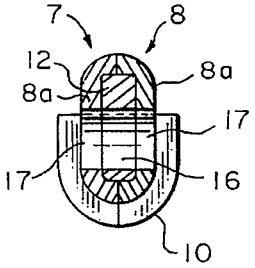
FIG. 5 is a section along the line V—V in FIG. 2.

The web 7, shown in section in FIG. 5, has a shell 8 of two equal shell halves 8*a*. These shell halves 8*a* are preferably cast, for example of zinc, aluminum or a suitable plastic material. The half shells 8*a*, however, can also be manufactured from another suitable material, for example chrome nickel steel. The half shells 8*a* each have a recess 19 on their inside, into which an interior part 12 has been inserted. The recesses 19 are embodied in such a way that together they can receive the interior part 12, and the half shells 8*a* which are placed against each other when laterally reversed surround this interior part on all sides, with the exception of a top 14*a*.

To receive lateral pins for connecting the web 7 with the housing parts 1*a* and 1*b* of a cylinder housing 1, the half shells 8*a* and the interior part 12 have respectively four aligned through-holes 17 and 16 located respectively in side legs 9 of the half shells 8*a* and side legs 13 of interior part 12. In addition, the center part 14 of interior part 12 has a threaded bore 15 to receive a cuff screw, not shown here, this bore being aligned with holes 11 in respectively one center part 10 of the half shells 8*a*. The interior part 12 has been stamped from a piece of sheet steel of a thickness of approximately 3 mm.

Figure 1:
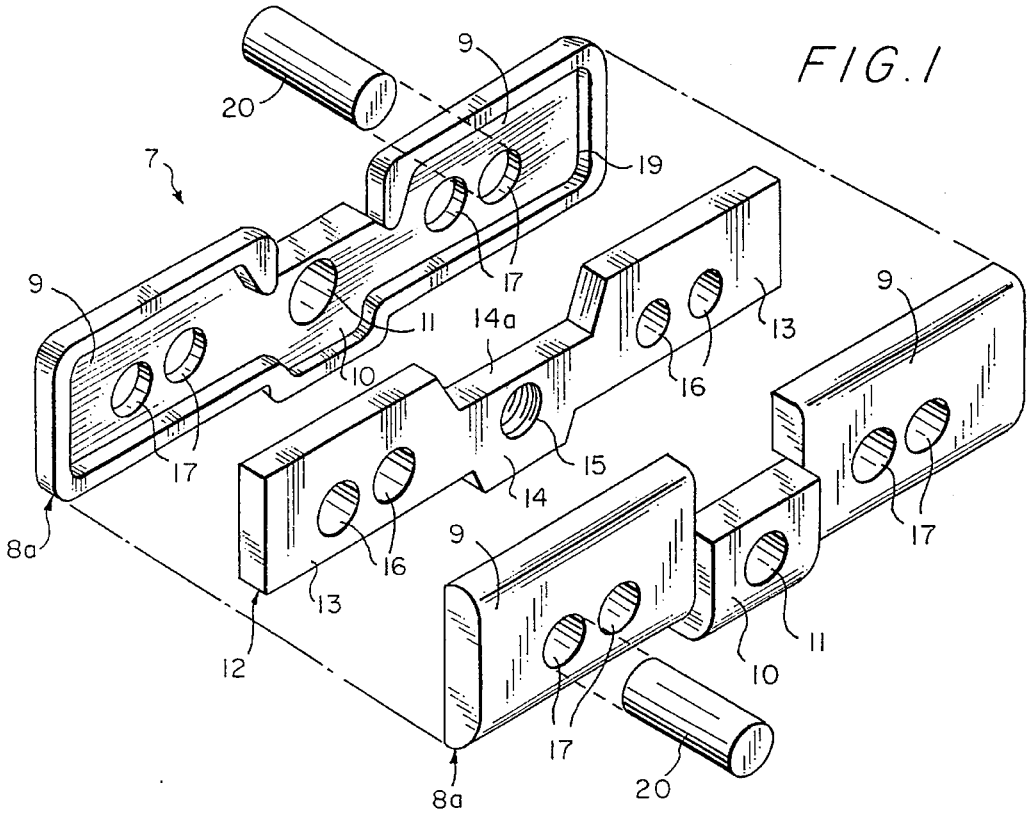
FIG. 1 is a perspective view of a web of the invention, wherein the outer parts have been drawn apart.
Figure 2:
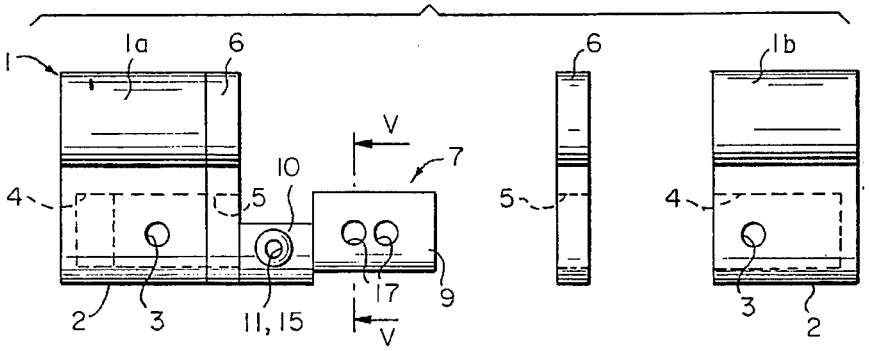
FIG. 2 is a partial view of a built-in double lock cylinder, wherein the parts are also drawn apart.
Figure 3:
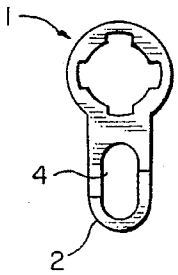
FIG. 3 is a front view of the cylinder half.
Figure 4:
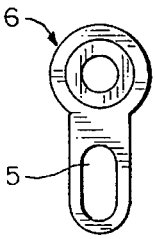
FIG. 4 is a front view of an extension disk.

As shown in FIG. 2, with each leg the web 7 engages a cutout 4 of a cylinder blind bore 2 and is fixedly connected therein with the housing parts 1*a* and 1*b* by means of the lateral pins 20, the ends of which engage holes 3 of the housing parts 1*a* and 1*b*. The housing parts 1*a* and 1*b* can be extended by means of disks 6 which also have respectively one cutout 5. The holes 16 and 17 are of course positioned in accordance with the thickness of the disks 6. Thus it is possible to connect selectively housing parts 1*a* and 1*b* with or without disks 6 with the web 7. The web 7 is conventionally installed into a safety lock with use of cuffscrews (not shown).

The two half shells 8*a* can also be plate-like flat sheet metal parts, not shown here, which are essentially embodied the same as the interior part 12, but which require only a smooth through-hole in place of the threaded bore 15. The center stamped sheet metal part 12 can have additional through-holes, which are engaged by cams or projections of the other stamped sheet metal parts in order to connect the parts in the longitudinal direction. The cams on the stamped sheet metal parts are produced simultaneously during stamping of the sheet metal parts and therefore are very cost-effective.

What is claimed:

1. A double lock cylinder having two cylinder housing parts, each part including a cylindrical case having at a bottom thereof, an extension which is provided with a cutout (4), the two cylinder housing parts being connected with a separately produced web, said web comprising two legs and a center part, each leg being inserted into the cutout, the web having a plurality of plate-like parts extending over the length of the web and in shiftable contact against each other, said web being made of three parts (8*a*, 8*a*, 12), two outer parts (8*a*, 8*a*) of the three parts abutting to form a shell (8), into which an interior part (12) has been inserted, wherein the shell (8) has two half shells (8*a*), each of the two half shells (8*a*) having a recess on an inner side receiving the interior part, and the interior part (12) of the plurality of plate-like parts has a threaded bore (15) for a cuff nut.

2. The double lock cylinder in accordance with claim 1, wherein the interior part (12) is a stamped part.

3. The double lock cylinder in accordance with claim 1, wherein at least one part of said plurality of plate like parts is a cast part.

4. The double lock cylinder in accordance with claim 1, wherein said web is produced from three stamped parts.

5. The double lock cylinder in accordance with claim 1, wherein at least one part (8*a*) of three parts is made of zinc, aluminum or a plastic material.

6. The double lock cylinder in accordance with claim 1, wherein the shell (8) is made of chrome nickel steel.

* * * * *